US007225949B2

(12) United States Patent
Kubo et al.

(10) Patent No.: US 7,225,949 B2
(45) Date of Patent: Jun. 5, 2007

(54) LIQUID DRUG CONTAINER

(75) Inventors: Tomohiko Kubo, Osaka (JP); Ikuko Asada, Osaka (JP)

(73) Assignees: Nipro Corporation, Osaka (JP); Wakamoto Pharmaceutical Co., Ltd., Tokyo (JP)

( * ) Notice: Subject to any disclaimer, the term of this patent is extended or adjusted under 35 U.S.C. 154(b) by 201 days.

(21) Appl. No.: 10/510,054

(22) PCT Filed: Apr. 4, 2003

(86) PCT No.: PCT/JP03/04318

§ 371 (c)(1),
(2), (4) Date: Oct. 1, 2004

(87) PCT Pub. No.: WO03/084460

PCT Pub. Date: Oct. 16, 2003

(65) Prior Publication Data

US 2005/0139611 A1 Jun. 30, 2005

(30) Foreign Application Priority Data

| | | |
|---|---|---|
| Apr. 4, 2002 | (JP) | 2002-102911 |
| Jul. 22, 2002 | (JP) | 2002-212231 |
| Nov. 20, 2002 | (JP) | 2002-336579 |

(51) Int. Cl.
*B67D 5/58* (2006.01)
*B65D 37/00* (2006.01)
*B65D 47/18* (2006.01)

(52) U.S. Cl. ..... 222/189.08; 222/189.09; 222/212; 222/421; 222/481.5

(58) Field of Classification Search ..... 222/189.08, 222/189.09, 212, 420, 421, 481.5
See application file for complete search history.

(56) References Cited

U.S. PATENT DOCUMENTS

| | | | | |
|---|---|---|---|---|
| 4,938,389 | A * | 7/1990 | Rossi et al. | 222/189.08 |
| 5,219,101 | A * | 6/1993 | Matkovich et al. | 222/189.06 |
| 5,265,770 | A * | 11/1993 | Matkovich et al. | 222/189.06 |
| 5,490,938 | A * | 2/1996 | Sawan et al. | 210/651 |
| 6,073,812 | A * | 6/2000 | Wade et al. | 222/189.09 |
| 2002/0130139 | A1 * | 9/2002 | Shiraishi et al. | 222/105 |
| 2002/0153386 | A1 * | 10/2002 | Uetake et al. | 222/1 |

FOREIGN PATENT DOCUMENTS

| | | | |
|---|---|---|---|
| JP | 61-2797 | A | 7/1987 |
| JP | 62-115370 | U | 7/1987 |
| JP | 4-6052 | A | 1/1992 |
| WO | WO-02/00160 | A1 | 1/2002 |

* cited by examiner

*Primary Examiner*—Joseph A Kaufman
(74) *Attorney, Agent, or Firm*—Birch, Stewart, Kolasch & Birch, LLP

(57) ABSTRACT

A liquid drug container comprises a container body 1; a nozzle member 2 liquid-tightly mounted on the container body 1; and a nozzle cap 6 fitted on the nozzle member 2. A nozzle hole 231 of the nozzle member 2 is covered with a hydrophilic filer 3, and a top wall of the nozzle member 2 is provided with an air hole 24 covered with a hydrophobic filter 4. The nozzle member 2 may be provided with a filter-mounting member 8 for attachment of the filters. Also, the nozzle member 2 may be provided with a flow control member that controls air flowing into the container body through the air hole.

15 Claims, 16 Drawing Sheets

(A)

(B)

LIQUID DRUG CONTAINER

CROSS-REFERENCE TO RELATED APPLICATION

The present application claims priority under 35 U.S.C. §119 to Japanese Patent Application No. JP 2002-102911, filed Apr. 4, 2002; JP 2002-212231, filed Jul. 22, 2002; and JP 2002-336579, filed on Nov. 20, 2002, the entire contents of which are hereby incorporated by reference.

BACKGROUND OF THE INVENTION

1. Technical Field

The present invention relates to a liquid drug container and, more particularly, a liquid drug container used for preservation of liquid drugs or liquid cosmetics and so designed that the interior of the container is prevented from being contaminated by bacterium or microorganisms.

2. Background Art

In containers used for preservation of liquid chemicals or liquid cosmetics, an interior of the container is not aseptically isolated from the exterior. Thus, if the container is unsealed to bring it into use, the interior of the container is exposed to the atmosphere through a nozzle of the container. Thus, there is a fear that floating bacteria in the atmosphere may invade the interior of the container through the nozzle. On the other hand, if the nozzle is brought into contact with the skin during use, there is a fear that the interior of the container is easily invaded by bacterium or microorganism adhered to the skin. Further, as the liquid drug container of this kind, there have been used such containers that discharge a content thereof under pressure of a hand and restore to the original configuration after release of the pressure applied thereto. At the time of return to the original configuration, the deformed container sucks in the surrounding air. Thus, there is a fear that bacteria and microorganism in the atmosphere are sucked in the interior of the container along with the air flowing into the container.

Accordingly, the liquid drug containers of the prior art are at high risk of multiplication of bacteria or microorganisms in the container body as the invaded bacteria or microorganisms take active constituents contained in the drug, buffer solutions added for stabilizing the liquid drug, or solubilizing agent as nutrients.

For purposes of antisepsis, sterilization or antibacterial activity, it is common practice to incorporate various kinds of preservatives into the liquid drugs of the prior art to prevent multiplication of bacteria or microorganism even if the container is invaded by bacteria or microorganism. The generally known preservatives include antiseptics of quaternary ammonium salts exemplified by benzalkonium chloride and benzethonium chloride. However, such salts are limited in use because of their strong stimulation and cytotoxic effects. Particularly, they can not be used as antiseptics for liquid drugs applied to eye tissues or organs sensitive to stimulus.

In recent years, reports have been made on so-called chemical hypersensitivity, i.e., symptom of serious allergy to chemical compounds such as preservative. For that reason, some chemicals and cosmetics containing no preservative have been developed and put to practical use. However, if the chemicals or cosmetics do not contain any preservative, it is impossible to ensure aseptic conditions after unsealing. This necessitates packaging of a dosage of such a chemical solution or a liquid cosmetic in a single disposable container, entailing an increase in production costs and space-consuming. Thus, the chemicals and cosmetics do not contain any preservative fail in popularization.

On the other hand, it has been proposed to make the container with a plastic deformable body (Examined Japanese utility model publication No. S63-184037, Japanese translation of PCT international application No. 2001-521865) to prevent invasion of floating bacteria or microorganism, which results from inflow of the atmosphere which occurs at the time of restoring of the pressure-deformed container to its original state by the pressure release after discharge of the liquid drug.

However, even if the container is of plastic deformable body, there is no change in the fact that the medical solution contained therein is exposed to the atmosphere through a dispensing nozzle. Thus, it is impossible to completely prevent invasion of bacteria and microorganism.

Further, there have been proposed some containers of the kind wherein the nozzle is provided with a filter to prevent invasion of bacteria and microorganism, which may take place when the liquid drug remained in the nozzle is returned to the container body after use, or when the elastically deformed container is restored to its original state by the pressure release (cf. Examined Japanese utility model publication No. S35-592, Examined Japanese utility model publication No. S35-31875).

However, even if the nozzle is provided with a filter, it is impossible to trap unobservable bacteria or microorganism since the filter, which allows both liquid and gas to pass therethrough, generally has a large bore size.

To this end, it has been proposed to provide the container with a hydrophilic filter or a hydrophobic filter that enable to trap unobservable bacteria or microorganism. However, if the filter is a hydrophilic filter, it is unable to allow the pressure-deformed container to restore to its original configuration since the hydrophilic filter prevents flow of the gas though it allows the liquid to pass through.

In order to allow the container to restore to its original configuration, it has been proposed a container provided with a hydrophobic filter allowing the atmosphere to flow in the container ((cf. Examined Japanese Patent publication No. H03-61461).

Since the nozzle hole serves as an air hole, the hydrophobic filter limits inflow of the atmosphere when the liquid drug that flows back from the nozzle is retained on the hydrophobic filter. Thus, the pressure-deformed container can not be restored to the original configuration.

Further, there is a container so designed as to block inflow of the atmosphere into the container to prevent invasion of bacteria (cf. Published Japanese Patent application No. JP2002-80055A).

As shown in FIG. 14, a container 102 of an embodiment of the above prior art includes a plug body 103 fitted in a mouth thereof. The plug body 103 is a top-closed cylindrical member, into which a top-closed fitting member 134 is fitted to form a space between a top of the plug body 103 and a top of the fitting member 134. The plug body 103 is provided with a nozzle 131 at a central part of the top thereof, while the fitting member 134 is provided with a valve hole 106 at a central portion of the top thereof. A filter 107 is arranged on a bottom side of the nozzle 131, and a check valve 108 is arranged on a upper side of valve hole 106. A space formed between the filter 107 and the check valve 108 serves as a space 109 holding a liquid drug.

In use, by exerting pressure on the container 102 with hand after taking off an outer cap 140, the liquid drug in the container passes through the valve hole 106, pushes the check valve 108 open, fills the holding space 109, and spouts from the nozzle 131. By loosing the pressure on the container 102, the container 102 begins to restore to the original configuration and produces a negative pressure, so that the discharge of the liquid drug is stopped. At the same time, the check valve 108 is closed and thus the container 102 is prevented from inflow of the ambient air even if the air flows in through the nozzle 131.

However, there is a fear that the liquid drug stays in nozzle 131, which in turn causes a fear of bleeding of bacteria in the tip portion of nozzle 131 being in direct contact with the ambient air. The thus polluted liquid drug is used for a patient in the next use. Even in the embodiment of the prior art, it is impossible to keep aseptic conditions of the liquid drug.

SUMMARY AND OBJECTS OF THE INVENTION

The present invention has been made in view of the aforesaid circumstances and aims at providing a liquid drug container of the kind wherein the container is adapted to discharge a liquid drug contained therein through a nozzle hole by applying a pressure, and then return to the original configuration thereof by releasing the applied pressure, and wherein the container is prevented from invasion of bacteria or microorganism even if the nozzle had been brought into contact with a skin with much saprophyte, such as fingers or a side.

According to the present invention, the above object is achieved by providing a hydrophilic filter that covers a nozzle hole of a liquid drug container; providing an air hole separate from the nozzle hole, said air hole being adapted to communicate an interior of the container body with an exterior of the container body, in stead of the nozzle hole that has lost the air permeability at the time of wetting of the hydrophilic filter; and covering said air hole with a hydrophobic filter.

A liquid drug container according to the present invention comprises a container body having a mouth at one end and being deformable under the pressure, a nozzle member liquid-tightly mounted on the mouth of the container body, and a nozzle cap mounted on the nozzle member, wherein said nozzle member is provided with a nozzle hole for discharging a liquid drug contained in the container body, and an air hole for communicating an interior of the container body to the exterior thereof, and wherein said nozzle member is further provided with a hydrophilic filer for covering said nozzle hole, and a hydrophobic filter for covering said air hole.

The container body is made of a flexible material which is elastically deformable under the pressure and easily restorable to the original configuration by release of the applied pressure, for example, one of various elastic polymers such as polypropylene, polyethylene, polyethylene terephthalate, polyethylene telenaphthalate, polyester, plasticized polyvinyl chloride, thermoplastic elastomer and polycarbonate.

The nozzle member comprises a top wall covering the mouth of the container body, a skirt portion extending from a periphery of the top wall toward a proximal end of the nozzle member, and a nozzle provided at a central area of the top wall and extending toward a distal end of the nozzle member. The nozzle hole passes through the top wall and extends to the tip of the nozzle. In addition to the nozzle hole, the top wall is provided with an air hole passing therethrough at a position spaced from the nozzle hole.

It is preferred that the hydrophilic filter and hydrophobic filter are in the form of a membrane and are welded to the inner side of the top wall of the nozzle member so as to cover the nozzle hole or air hole, respectively. Such filters are classified broadly into two categories, i.e., a "depth type" that traps bacteria within the filter, and a "screen type" that traps bacteria on surfaces of the filter, both of which can be used for the container of the present invention. It is preferred that the hydrophilic filter and hydrophobic filter have a bore size of 0.45 μm or below, more preferably, 0.22 μm or below to prevent *Candida albicans, Pseudomonas genera* and *Burkholderiacepacia*, which are generally known as pollutive bacteria, from invading the interior of the container.

In order to improve the flow of liquid or gas, the nozzle member may be provided in an inner side of the top wall with a groove connected to the nozzle hole and a groove connected to the air hole. Each groove is covered with the hydrophilic filter or hydrophobic filter.

In a preferred embodiment, the liquid drug container of the present invention is provided on its nozzle cap with a sealing portion for sealing the tip of the nozzle member.

In another preferred embodiment of the liquid drug container according to the present invention, the hydrophilic filter and the hydrophobic filter are arranged separately either on upper or lower side of the top wall so as not to interfere with one another.

In another preferred embodiment of the present invention, the liquid drug container comprises a flexible body having a mouth at one end and being easily deformable under the pressure; and a nozzle member liquid-tightly mounted on the mouth of said body; characterized in that said nozzle member is provided with a nozzle hole and an air hole which communicate an interior of the container body with the atmosphere, a hydrophilic filer covering said nozzle hole, a hydrophobic filter covering said air hole, and a flow control member for controlling inflow of the air to the interior of the container body through said air hole.

In another preferred embodiment, the nozzle member is provided with a nozzle-communicating hole and a flow control member for controlling the air that flows into the interior of the container body through said nozzle-communicating hole.

In still another preferred embodiment, the nozzle member is provided with a flow control member that controls air flowing into the container body through the nozzle-communicating hole.

In another embodiment, the nozzle member is provided with a filter-mounting member having a nozzle-communicating hole and an air-communicating hole, which respectively communicated with the nozzle hole and air hole, the filter-mounting member is provided with a flow control member that controls air flowing into the container body from the exterior thereof through the nozzle-communicating hole and air-communicating hole. The flow control member may be a check valve or a diaphragm.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
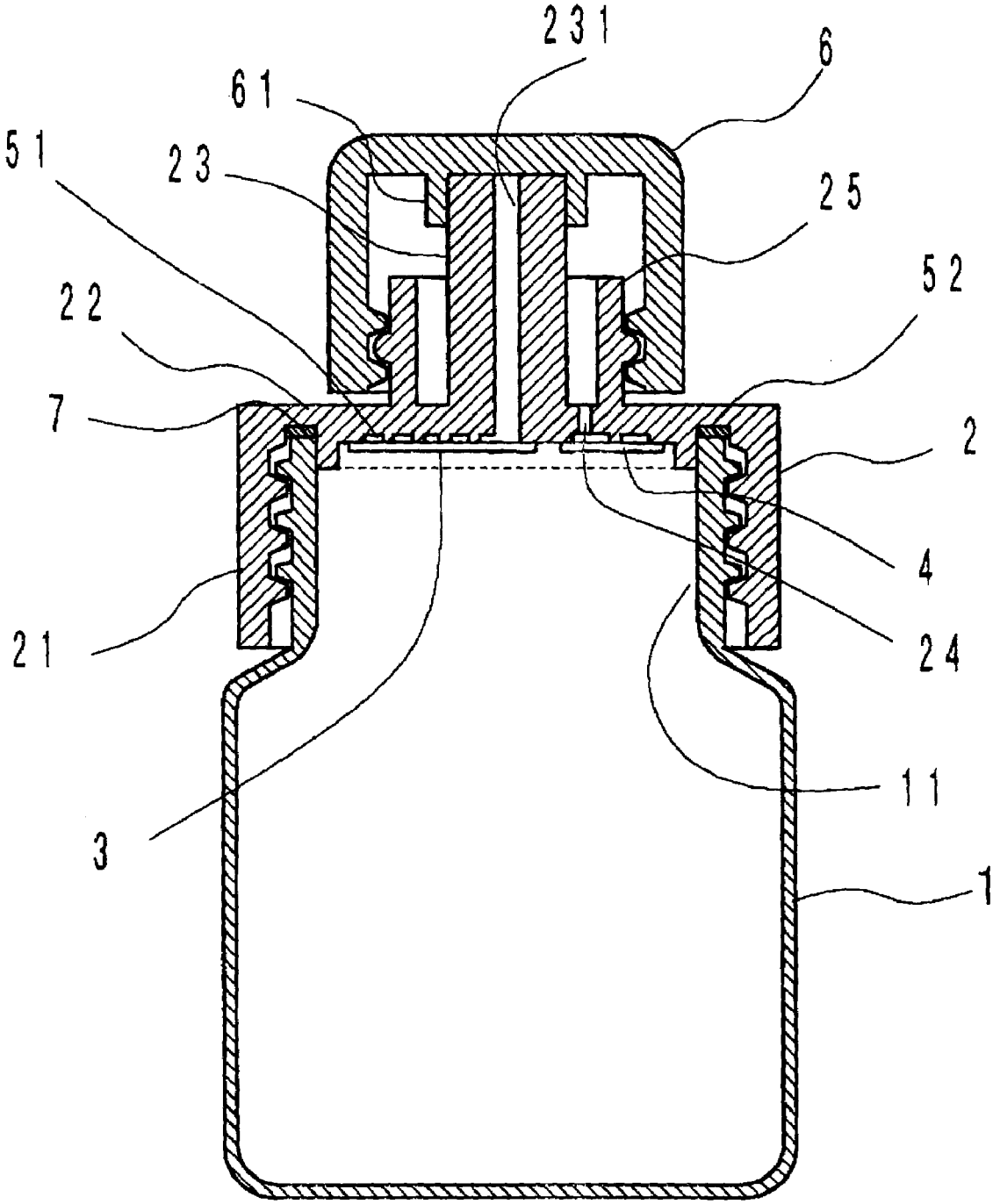
FIGS. 1 and 1A are longitudinal sections of a liquid drug container of the present invention.

An embodiment of the present invention will be explained below in detail to clarify the present invention more concretely, making reference to accompanying drawings. In the drawings, the same reference numerals denote the same or equivalent throughout the figures.

Figure 2:
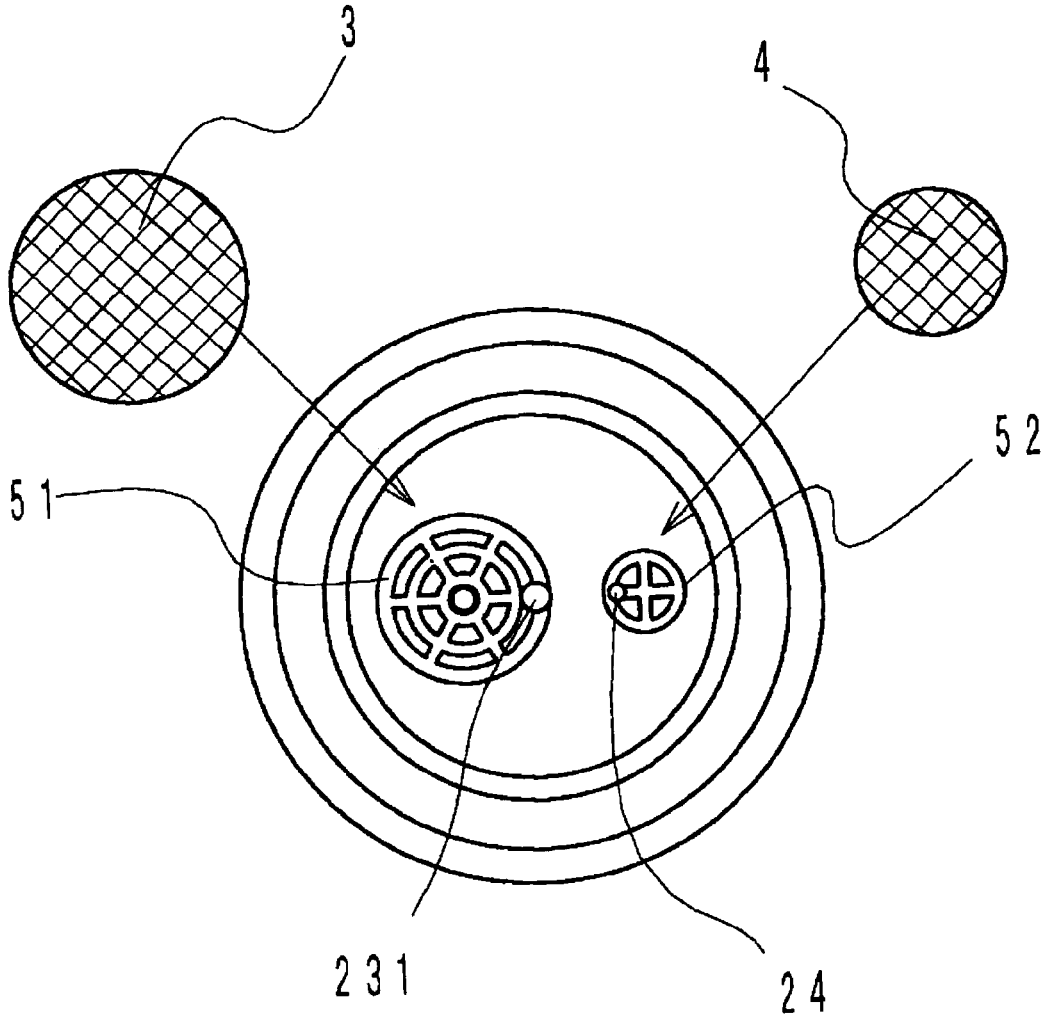
FIGS. 2 and 2A are exploded bottom plan views of a bottle cap with a filter being removed.
Figure 3:
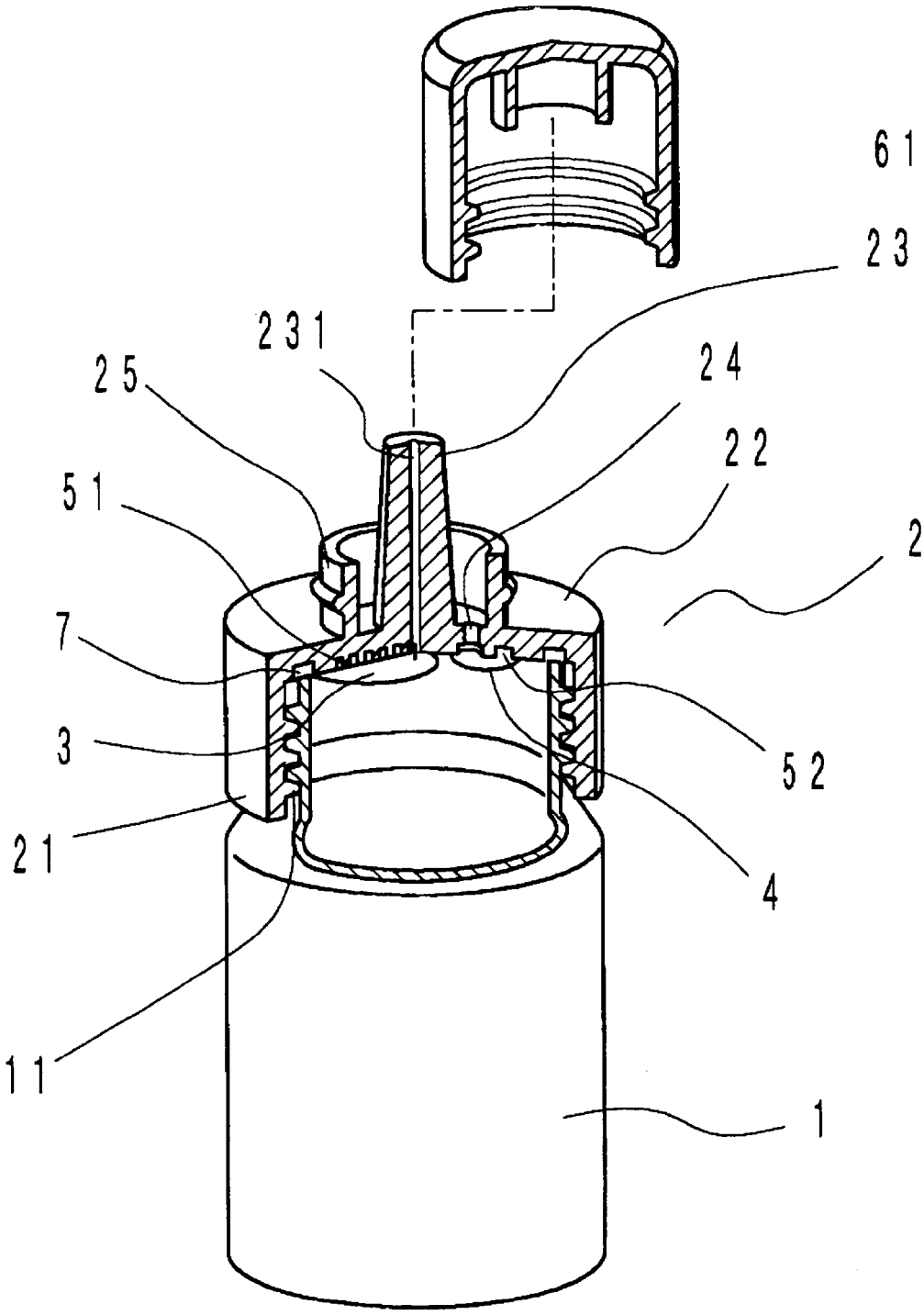
FIG. 3 is a partially cutaway perspective illustration of a liquid drug container of the present invention.

FIG. 1 is longitudinal section of a liquid drug container of the present invention; FIG. 2 is an exploded bottom plan view of a bottle cap shown in FIG. 1 (illustrated is a condition where a filter is removed); and FIG. 3 is a partially cutaway perspective illustration of a liquid drug container of the present invention.

As shown in FIG. 1, a liquid drug container of the present invention comprises a body 1, a bottle cap or a nozzle member 2 liquid-tightly mounted on the container body 1, and a nozzle cap 6 mounted on the nozzle member 2. An nozzle hole 231 of the nozzle member 2 is covered with a hydrophilic filter 3. The nozzle member 2 is provided in a top wall 22 thereof with an air hole 24 that is covered with a hydrophobic filter 4.

The container body 1 is usually formed in the configuration of a bottom-closed cylinder and is provided at a top thereof with a mouth portion 12 having a diameter smaller than that of a barrel portion 11. A material used for the container body is a flexible polymeric material that is deformable under the pressure and easily restorable to its original configuration at the time of releasing from pressing. Such a flexible polymeric material includes various polymeric material having elasticity, such as polypropylene, polyethylene, polyethylene terephthalate, polyethylene terenaphthalate, polyester, plasticized polyvinyl chloride, thermoplastic elastomer and polycarbonate.

The nozzle member 2 is a cap-shaped member and is provided with a skirt portion 21 extending from the peripheral portion of the top wall 22 towards a proximal end thereof. As required, a gasket 7 may be arranged Between skirt portion 21 and mouth portion 12 of the container body 1. The nozzle 23 is made into a cylindrical form or a truncated cone configuration projecting from the top wall 22 of the nozzle member 2 towards the distal end thereof. The nozzle 23 is provided with a nozzle hole 231 longitudinally passing therethrough and serving as a flow path for liquid. A proximal end of the nozzle hole 231 is covered with a hydrophilic filter 3 arranged on the inner wall of the top wall 22.

In the above-preferred embodiment, the nozzle member 2 is provided on its top wall 22 with a cylindrical wall 25 coaxially with the nozzle 23. The air hole 24 is so formed in the top wall 22 as to pass through a portion of the top wall 22 between nozzle 23 and cylindrical wall 25. The air hole 24 is covered with a hydrophobic filter 4 arranged on the inner side of top wall 22. If the air hole 24 is provided in a position separated from the nozzle hole 231, it is not necessarily required to provide the cylindrical wall 25 on the top wall.

According to the present invention, proper air flow of the air hole 24 is ensured by providing the air hole 24 covered with the hydrophobic filter 4 in a different position separated from the nozzle hole 231 covered with the hydrophilic filter 3.

Filters 3 and 4 are generally mounted on the inner side of the nozzle member by welding. The welding includes ultrasonic welding, high-frequency welding and thermal welding. A preferred method in the present invention is thermal welding.

It is preferred that the hydrophilic filter and hydrophobic filter have a bore size of 0.45 μm or below, more preferably, 0.22 μm or below to prevent *Candida albicans, Pseudomonas genera* and *Burkholderiacepacia*, which are generally known as pollutive bacteria, from invading the interior of the container. A trapping mechanism of the filter is classified broadly into two categories, i.e., a "depth type" that traps bacteria within the filter, and a "screen type" that traps bacteria on surfaces of the filter. Any type of the filter can be used for the present invention.

Air flow and liquid flow can be improved by providing the inner side of the top wall 22 of the nozzle member 2 with grooves 51 that communicate with the nozzle hole 231 and grooves 52 that communicate with the air hole, and welding filters 3 and 4 so as to cover the grooves 51 and 52 respectively, as shown in FIG. 2. In this case, there is no fear that the filter with a large filtration area peels off or becomes damaged at the time of pressing even if the filter is welded to the nozzle member 2 at an outer edge thereof.

The nozzle cap 6 is made in the form of approximate cylinder with a mouth. The nozzle cap 6 is provided with a sealing portion 61 that protrudes inwardly from the top wall of the cap 6 and comes into close contact with the tip of the nozzle 23 to air-tightly seal the nozzle hole 231. The sealing portion 61 is generally formed into a cylindrical form.

In this embodiment, the nozzle cap 6 is designed so as to be screw-mounted or fitted on the cylindrical wall 25. If there is no cylindrical wall 25, the nozzle cap 6 is so designed as to be screw-mounted or fitted on the skirt portion 21 of the nozzle member 2. The nozzle cap 6 may be a member adapted to be fitted on the nozzle 23, e.g., a rubber cap configured only by a sealing portion 61.

Since the nozzle hole of the nozzle member is covered by the hydrophilic filter and since the nozzle member is provided with the air hole covered with the hydrophobic filter separate from the nozzle hole, the above liquid drug container of the present invention makes it possible to prevent bacteria and microorganism from invading the interior of the container even if the nozzle of the liquid drug container is brought into contact with the skin at the time of use.

The liquid drug container of the present invention has remarkable effects when used for liquid drugs requiring higher abacterial than cosmetics, in particular, when used as an eyedropper for holding an ophthalmic solution limited in addition of a preservative.

Referring now to FIG. 4 to FIG. 7, there is shown another embodiment of the liquid drug container according to the present invention.

The Liquid drug container of this embodiment comprises a flexible container body 1 easily deformable under the pressure, and a nozzle member 2 liquid-tightly attached to the container body and provided with a nozzle and an air hole that communicate an interior of the container body to the exterior thereof. The liquid drug container is provided with a hydrophilic filter 3 for covering the nozzle of the nozzle member 2, a hydrophobic filter 4 for covering the air hole, and a filter-mounting member 8. The filter-mounting member 8 holds the hydrophilic filter 3 and the hydrophobic filter 4 within the nozzle member 2 separately on either an upper and lower side thereof so that they do not cause interference with each other.

Figure 4:
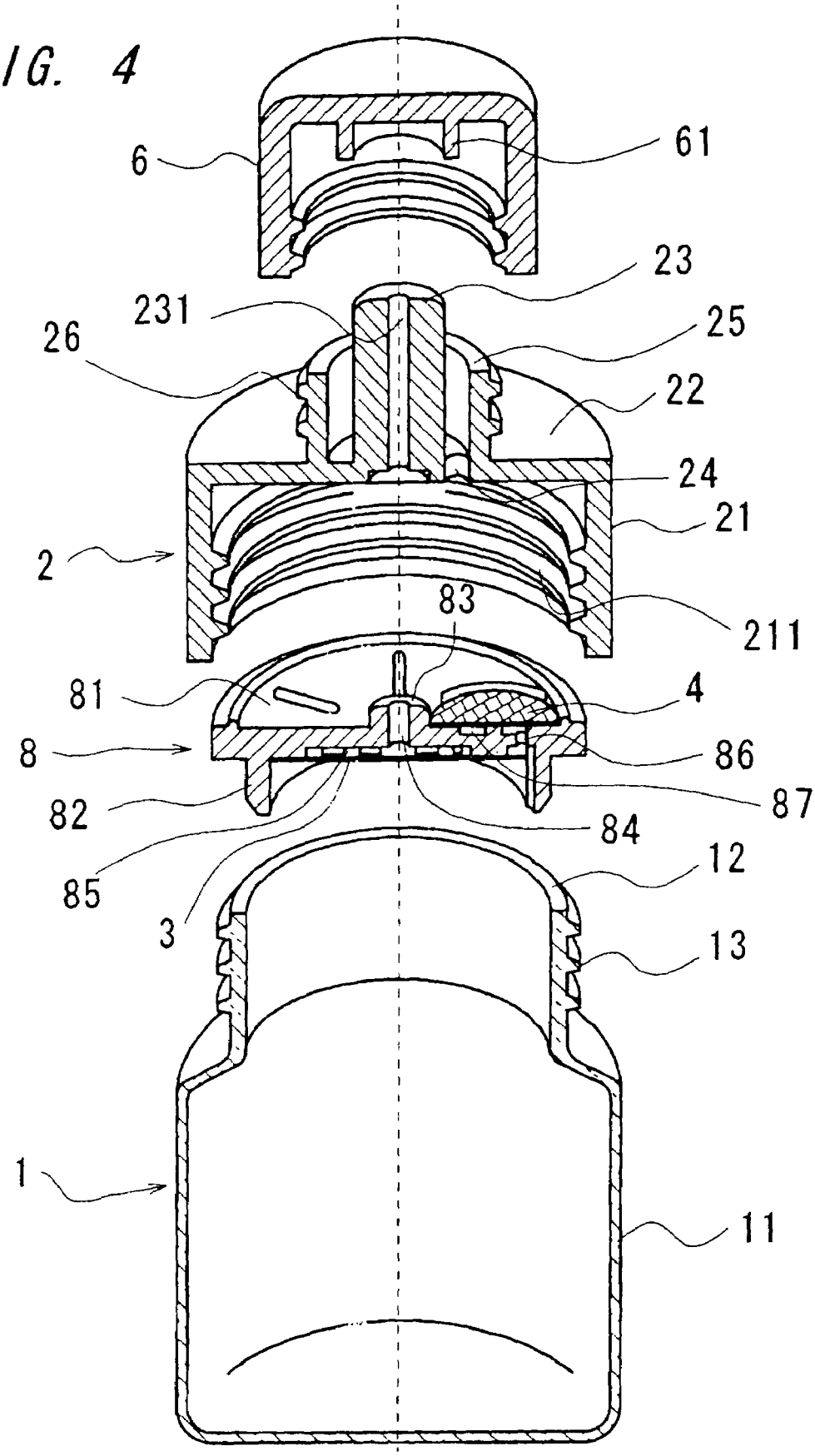
FIG. 4 is an exploded perspective view of a liquid drug container illustrating another embodiment of the present invention.

As best shown in FIG. 4, the container body 1 is a bottom-closed cylindrical container of a flexible polymeric material. The container body 1 has a mouth 12 with a diameter smaller than that of a barrel 11 at a top thereof, and is provided on an external wall of a neck portion thereof with a male thread 13 for engagement with the nozzle member 2 mentioned below.

The nozzle member 2 is a cap-shaped member comprised of a discoid top wall 22 covering mouth of container body 1 and a skirt portion 21 hanging down from the outer edge part of the top wall 22. The skirt portion 21 is provided in an inner wall thereof with a female screw 211. This female screw 211 is adapted to be engaged with the male screw 13 of the mouth 12. Thus, the container body 1 can be sealed liquid-tightly by screw-mounting the nozzle member 2 on the mouth portion.

The top wall 22 is provided at a central part thereof with a nozzle 23 that protrudes on the opposite side of the skirt portion. The nozzle 23 is made into a cylindrical form or a truncated cone form and is provided with a nozzle hole 231 longitudinally passing through the nozzle and serving as a liquid flow path. The nozzle member 2 is further provided with a cylindrical wall 25 extending coaxially with the nozzle 23 from the top wall 22 of the nozzle member and surrounding the nozzle 23. The cylindrical wall 25 is provided in an external wall thereof with male screw 26.

The top wall 22 of the nozzle member 2 is provided with an air hole 24 passing through the top wall 22 at a position between the nozzle 23 and cylindrical wall 25. The air hole 24 is not always limited to one location, and may be formed in several locations.

Figure 6:
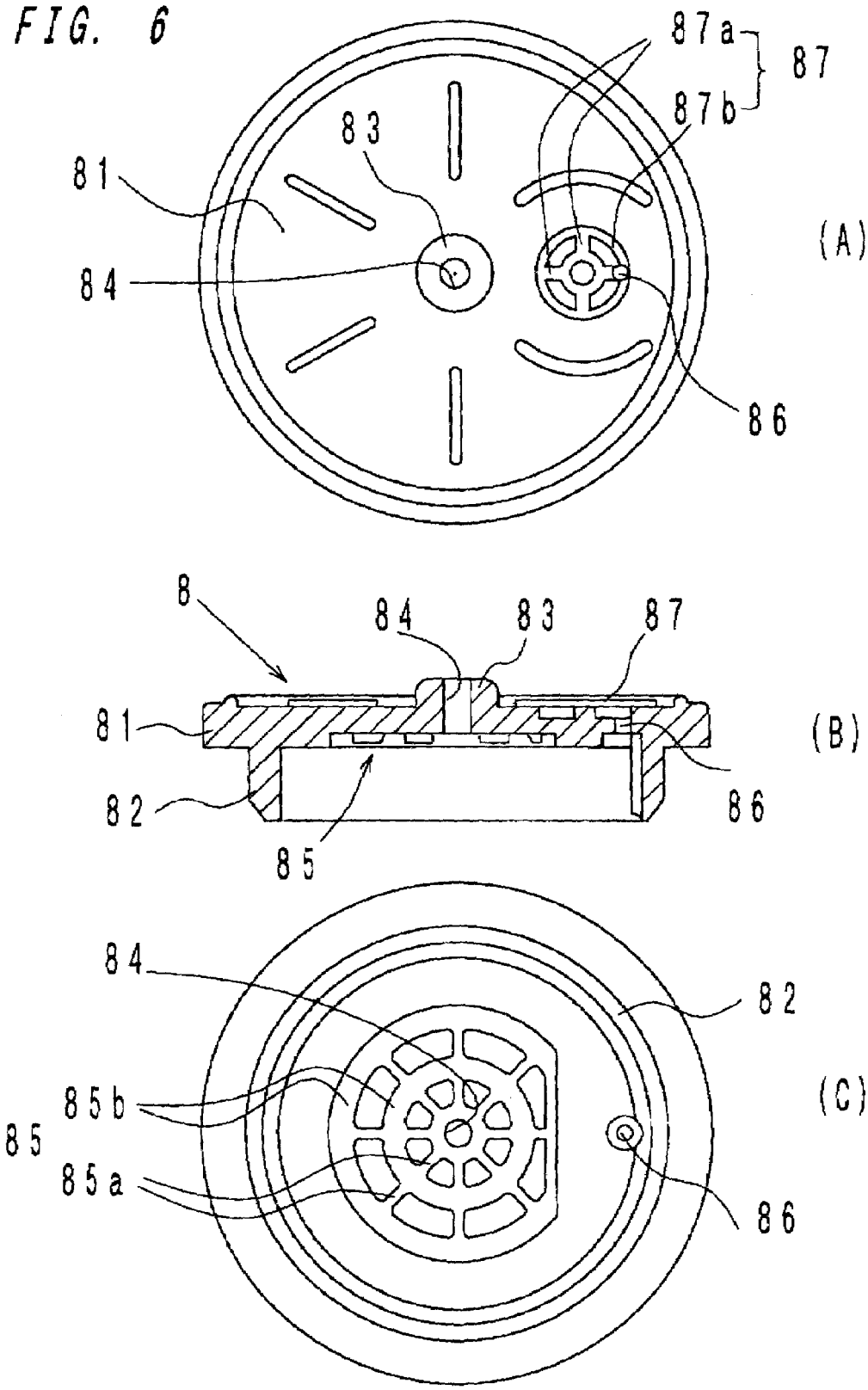
FIG. 6 illustrates a filter-mounting member used in the liquid drug container of FIG. 4, in which Figure (A) is a plan view, Figure (B) is a section view, and Figure (C) is a bottom plan view.

The filter-mounting member 8 is a generally disc-shaped member and includes a disc-shaped body 81 and a skirt portion 82 formed in the form of a ring on the opposite side of the mounting side, as shown in detail in FIG. 6. An external diameter of the disc-shaped body 81 is set to a size that fits into the bore of the nozzle member 2, and an external diameter of skirt portion 82 is set to a size that fits into the opening of the mouth 12 of the container body 1.

Figure 5:
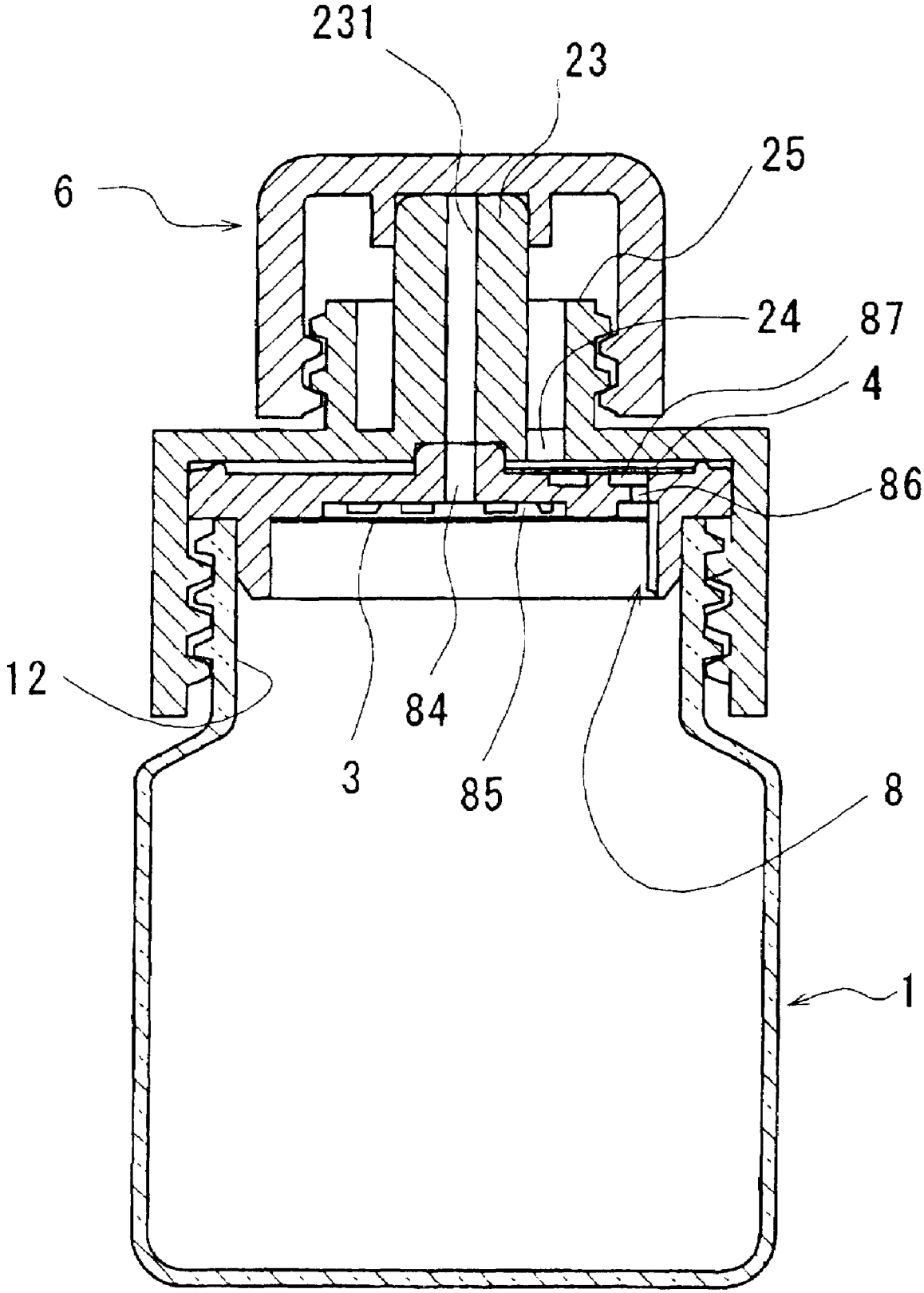
FIG. 5 is a sectional view of the liquid drug container shown in FIG. 4.

Thus, the filter-mounting member 8 can be fixed between the mouth 12 and the backside of nozzle member 2 as shown in FIG. 5. This may be done by inserting the filter-mounting member 8 into the bore of the nozzle member 2, and then engaging the nozzle member 2 with the mouth 12 of the container body 1.

The filter-mounting member 8 is provided with a small cylindrical projection 83 projecting from an upper central part of the mounting side 81. Also, the filter-mounting member 8 is provided with a nozzle-communicating hole 84 passing through a central part of the cylindrical projection 83 and extending from the top of the cylindrical projection 83 to the opposite end of the mounting side 81.

The opposite side of the mounting side 81 is provided with a set of grooves 85 around the nozzle-communicating hole 84. The set of grooves 85 include radial grooves 85*a* communicated with the nozzle-communicating hole 84 and annular grooves 85*b* communicated with the radial grooves 85*a*.

Also, an air-communicating hole 86 is provided at a position radially and outwardly spaced from the center of the mounting side 81 and on the inner side of the skirt portion 82. Provided on the upper side of mounting side 81 and around the air-communicating hole 86 is a set of groove 87. The set of groove 71 includes radial grooves 87*a* communicated with the air-communicating hole 86 and annular groove 87*b* communicated with the radial grooves 87*a*.

In the embodiment with the above structure, as shown in FIG. 5, the filter-mounting member 8 is fixed on the upper part of the mouth portion 12 by screw-mounting the nozzle member 2 on the mouth portion 12 of the container body 1. Under such a condition, the nozzle hole 132 of the nozzle 23 is communicated with the interior of the container body 1 through the nozzle-communicating hole 84, while air hole 24 is communicated with the interior of the container body 1 through the air-communicating hole 36.

Figure 7:
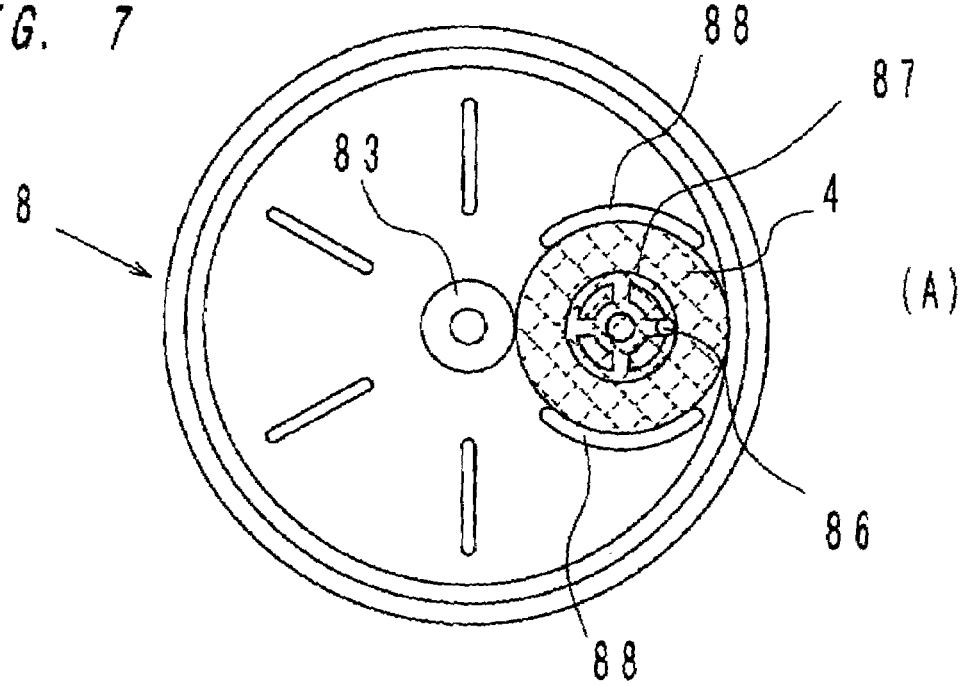
FIG. 7 illustrates a filter-mounting member equipped with a filter, figure (A) is a plan view, and figure (B) is a bottom plan view.
Figure 7:
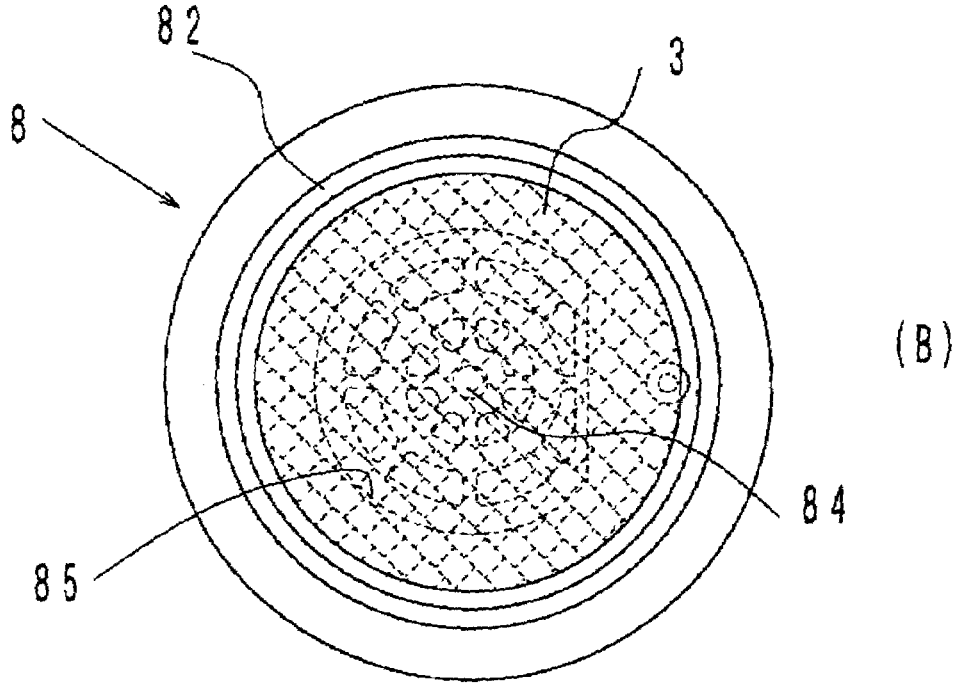
Figure 8:
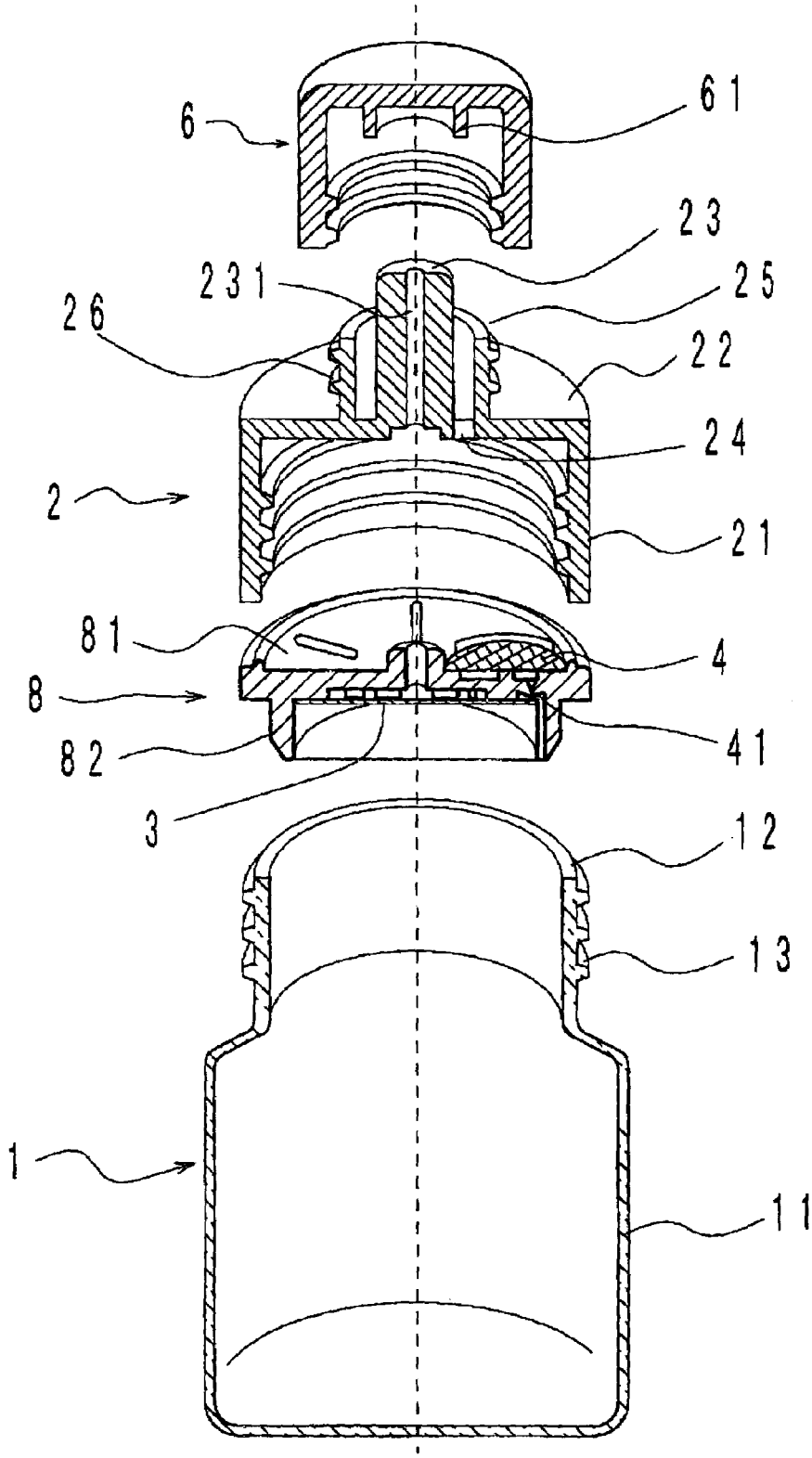
FIG. 8 is an exploded perspective view of a liquid drug container according to one embodiment of the present invention.

As shown in FIGS. 5 and 7, the hydrophilic filter 3 is attached to the bottom face of the filter-mounting member 8, while the hydrophobic filter 4 is attached to the top face of the filter-mounting member 8.

The hydrophilic filter 3 and hydrophobic filter 4 are formed in a flat membrane and are members that can be mounted by welding. The usable welding process includes ultrasonic welding, high-frequency welding and thermal welding. In the present invention, it is preferred to use thermal welding.

As shown in FIG. 7, it is possible to cover the nozzle-communicating hole 84 and groove 85 by welding the hydrophilic filter 3 onto the groove 85 and surrounding area thereof on the bottom side of the filter-mounting member 8. In the drawings, reference numeral 88 denotes a positioning rib for the hydrophobic filter 4.

In the present embodiment, the hydrophilic filter 3 and hydrophobic filter 4 do not cause interference with each other since they are separately arranged on the top and bottom sides of the filter-mounting member 8. Further, it is possible to use large sized filters 3 and 4 unless the diameter of each filter 3, 4 exceeds the diameter of filter-mounting member 8.

In this way the diameter of hydrophilic filter 3 which directly have an influence on easiness of discharge easiness of liquid drug was enlarged to the inner diameter of skirt portion 82 of filter-mounting member 8. Thus, the present embodiment make it possible to realize considerably good discharge characteristics of the liquid drug even if the hole of the hydrophilic filter 3 is reduced in diameter.

As the filters 3 and 4, there have been used such filters each having a bore size of 0.45 μm or below, preferably, 0.22 μm or below to prevent contamination source bacteria from invading the interior of the container.

The trapping mechanism of the filter is classified broadly into two categories, i.e., a "depth type" that traps bacteria within the filter, and a "screen type" that traps bacteria on surfaces of the filter. Any type of the filter can be used for the present invention.

As illustrated in FIGS. 4 and 5, the nozzle cap 6 is a generally cylindrical member opened at a bottom thereof and closed at the top. The nozzle cap 6 is provided on the internal surface side of its top wall with a sealing portion 61, which is brought into close contact with a tip of the nozzle 23 to hermetically seal the nozzle hole 231 of the nozzle 23. The sealing portion 61 is generally formed into a cylindrical configuration.

In this embodiment, the nozzle cap 6 is screw-mounted or engaged with the cylindrical wall 25 of the nozzle member 2. If the nozzle member 2 has no cylindrical wall 25, the nozzle cap 6 is so designed as to be screw-mounted or engaged with the peripheral portion of the skirt portion 21 of the nozzle member 2. The nozzle cap 6 may be a member to be fitted on the nozzle 23, e.g., a rubber cap configured only by a sealing portion 61.

In the above embodiment, the hydrophilic filter 3 is mounted on the bottom side of the filter-mounting member 8, while the hydrophobic filter 4 is mounted on the top of the filter-mounting member 8. Contrary to this embodiment, the hydrophilic filter 3 may be mounted on the top of the filter-mounting member 8, and the hydrophobic filter 4 may be mounted on the bottom side of the filter-mounting member 8. In that case, the hydrophilic filter 3 may be welded without trouble, provided that cylindrical projection 83 is removed to make the top of filter-mounting member 8 flat.

Figure 1A:
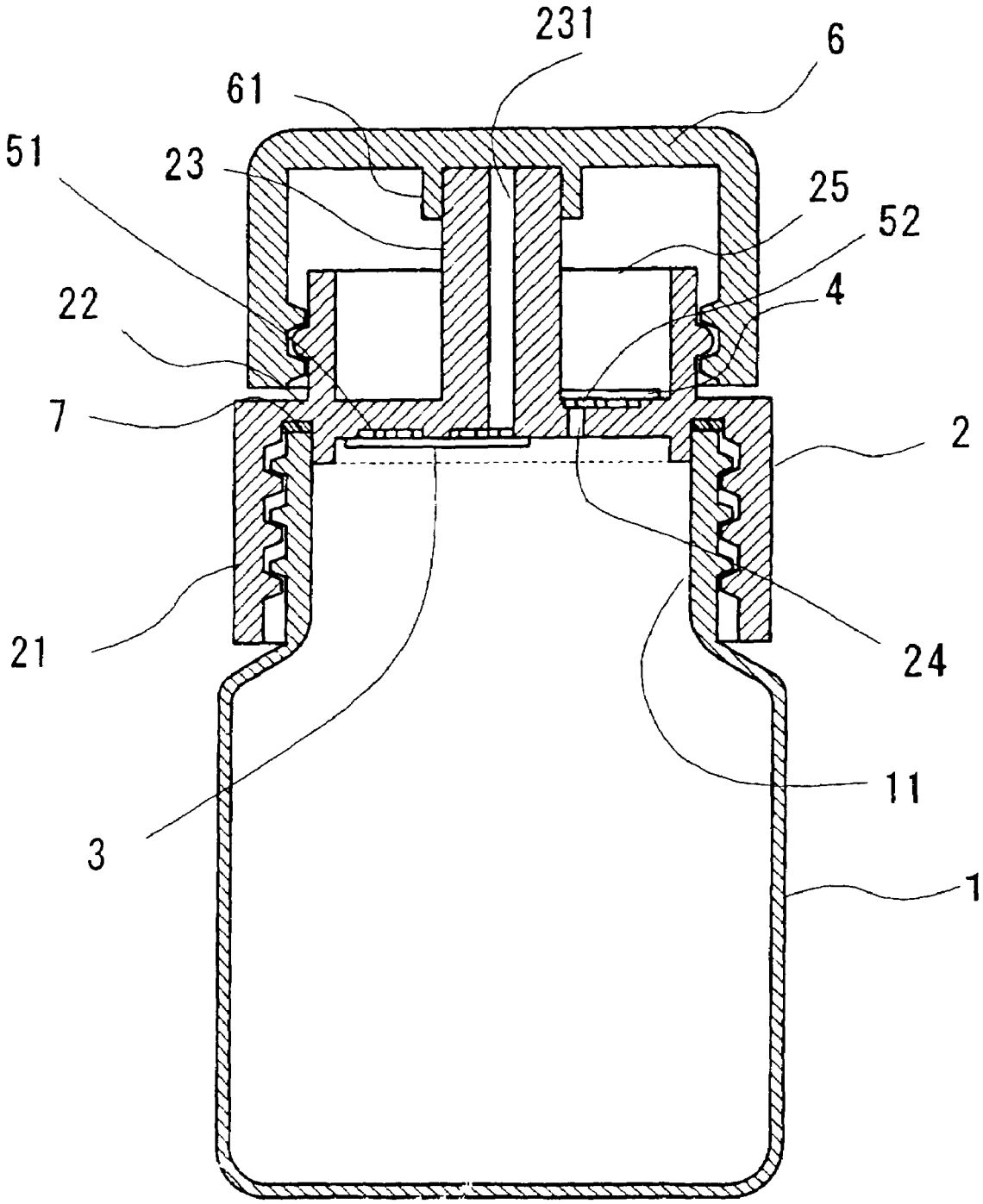
Figure 2A:
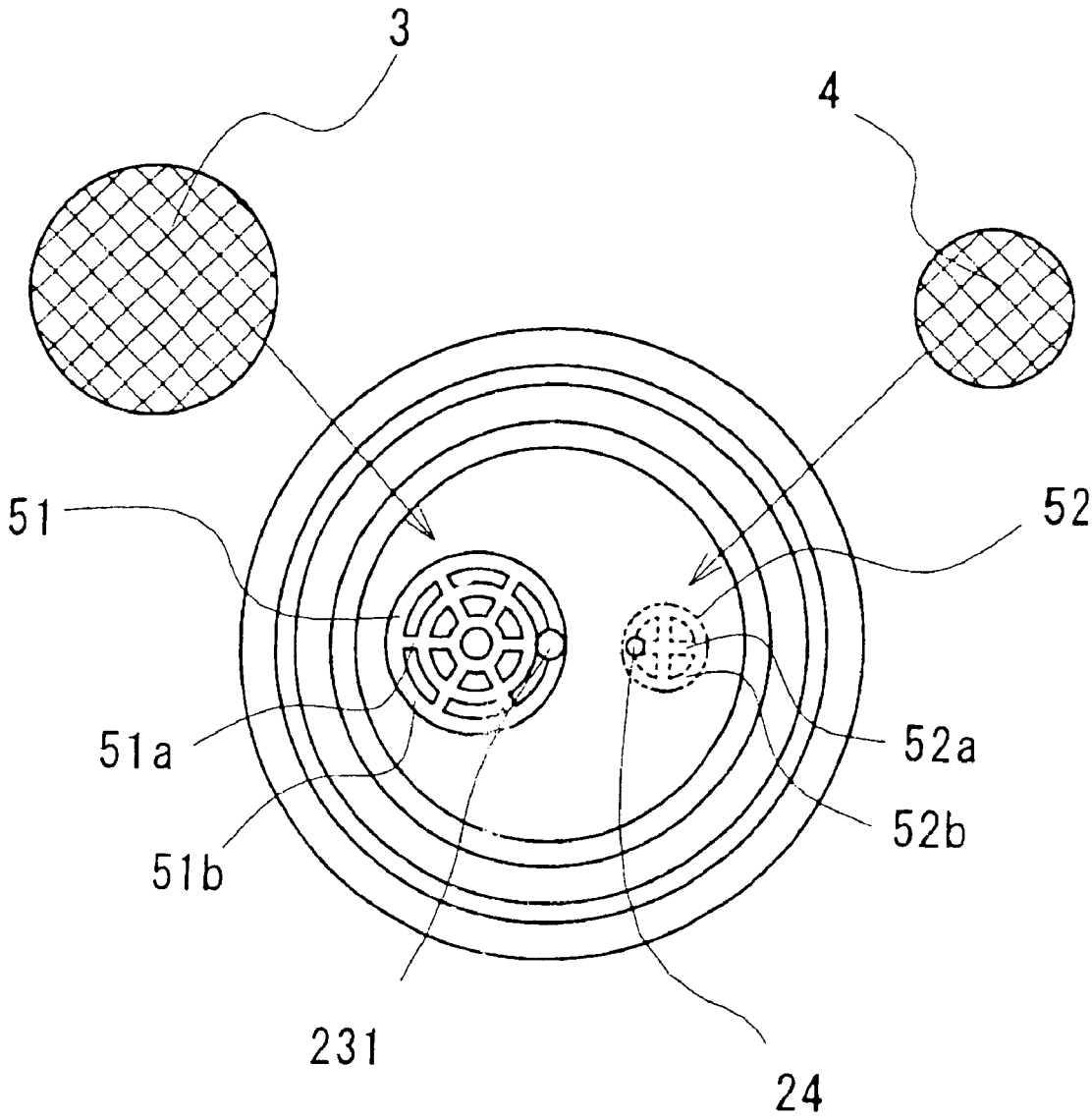

In the above embodiment, the filter-mounting member 8 was used to mount the hydrophilic filter 3 and hydrophobic filter 4 on the nozzle member. However, the hydrophilic filter 3 and hydrophobic filter 4 may be attached directly to the nozzle member 2 without use of the filter-mounting member. In that case, the hydrophilic filter 3 is welded to the inner side of the top wall 22 of the nozzle member 2 that has been provided with a groove communicating with the nozzle hole 231, while the hydrophobic filter 4 is welded to the outer side of the top wall that has been provided with a groove communicating with the air hole 24. The hydrophobic filter 4 can be covered with a large-sized nozzle cap 6 (see FIGS. 1A and 2A).

The liquid drug container of the present invention has remarkable effects when used for liquid drugs requiring higher abacterial than cosmetics, in particular, when used as an eyedropper for holding an ophthalmic solution limited in addition of a preservative.

Since the liquid drug container of the present invention is provided with the air hole in addition to the nozzle hole, and since the nozzle hole and the air hole are respectively covered with the hydrophilic filter and hydrophobic filter each having a small bore size, it is possible to prevent microorganism known as contamination cause bacteria from invading the interior of the container without decrease in easiness of handling. In addition, the hydrophilic filter and hydrophobic filter are separately arranged on either upper or under side of the top wall or of the filter-mounting member, and do not cause interference with each other, thus making it possible to widen effective areas of respective filters. Thus, this makes it easy to discharge the liquid drug and allows the deformed container to return to the original configuration with ease.

Use of the filter-mounting member makes it possible to arrange the hydrophilic filter and hydrophobic filter can be arranged at different levels without causing complicated structure of the nozzle member. In that case, the hydrophilic filter and hydrophobic filter are separately attached to inner and outer sides of the filter-mounting member.

The filter-mounting member can be fitted in the interior of the nozzle member and sandwiched between the internal surface of the nozzle member and mouth portion of the container body. Thus, it is easy to incorporate the hydrophilic filter and the hydrophobic filter, which should be arranged on upper and lower levels, into the container.

Further, the liquid drug container can be made into compact since the above two kinds of filters are in the form of a flat membrane, of which a mounting space is very small.

The provision of the grooves makes it possible to improve the liquid drug flow at the time of discharge as well as to improve the airflow at the time of inflow of the air, thus making it possible to improve user-friendliness of the container.

A liquid drug container shown in FIGS. 8–12 comprises a container body 1, a cap-shaped nozzle member 2 and a nozzle cap 6. The nozzle member 2 is provided with a nozzle hole 231 and air hole 24, which communicate the interior of the container body 1 with the exterior thereof.

The nozzle member 2 is further provided with a hydrophilic filter 3 covering the nozzle hole 231, and a hydrophobic filter 4 covering air hole 24. These members have approximately the same constructions as those of the corresponding members of the liquid drug container shown in FIG. 1.

The liquid drug container 1 in this embodiment further comprises a filter-mounting member 8 in addition to the aforesaid constituent members. The filter-mounting member 8 is an approximately disc-shaped member and is comprised of a disc-shaped body 81 and an annular skirt portion 82 formed on the bottom of the disc-shaped body 81, as illustrated in detail in FIG. 10. An external diameter of the disc-shaped body 81 is set to proper size for fitting into the skirt portion 21 of nozzle member 2. An external diameter of the skirt portion 82 is set to proper size for fitting into the mouth 12 of the container body 1.

The disc-shaped body 81 is provided at a central portion thereof with a small cylindrical projection 83 and a nozzle-communicating hole 84 passing through the center of cylindrical projection 83 and extending from the upper end of the cylindrical projection 83 to the bottom face of the disc-shaped body 81. The nozzle-communicating hole 84 is communicated with the nozzle hole 231 of the nozzle 23. The disc-shaped body 81 is provided in its bottom face with grooves 85 surrounding the nozzle-communicating hole 84. The grooves 85 include radial grooves 85*a* communicated with the nozzle-communicating hole 84, and annular groove 85*b* communicated with these radial grooves 85*a*.

The disc-shaped body 81 is further provided with air-communicating hole 86 at a position radially spaced from the center thereof but inside of the skirt portion 82. The air-communicating hole 86 passes through the disc-shaped body 81 from its top to the bottom. The disc-shaped body 81 is provided with grooves 87 around the air-communicating hole 86 on the topside of the disc-shaped body 81. The grooves 87 include radial grooves 87*a* communicated with the air-communicating hole 86, and annular groove 87*b* communicated with these radial grooves 87*a*. Thus, the air-communicating hole 86 is communicated with the air hole 24 through the grooves 87.

Furthermore, the disc-shaped body 81 is provided with a flow control member 41 for controlling air flowing into the container body 1 through the air hole 24. The flow control member 41 may have any construction, provided that it has a function to limit the flow rate of the air. In the present invention, a preferred flow control member includes check valves and diaphragms, but any other flow control member may be used as the flow control member 41. The diaphragms include choke valves and orifices.

In the above embodiment, a check valve 41 is provided in the air-communicating hole 86 which is a flow path from the air hole 24 to the container body 1. The check valve 41 may be formed as an integral part of the filter-mounting member 8 or as a separate member to be fitted into and fixed to the filter-mounting member 8. If the check valve 41 is formed as an integral part of the filter-mounting member 8, a valve body of the check valve 41 is required to have elasticity. There is no limit to a material for the filter-mounting member 8, provided that it is a soft material with elasticity and allows the filter to be welded thereto. A specific material for the filter-mounting member includes for example, thermoplastic elastomer and polyolefin resins (low-density polyethylene, random polypropylene). On the other hand, when the check valve 41 is provided as a separate member, a material for check valve 41 includes, silicone rubber and vulcanized rubber such as isobutylene-isoprene rubber in addition to the aforesaid thermoplastic elastomer and polyolefin resins. In this case, as a raw material of filter-mounting member 8, there may be used any polymeric material which has been time-proven as a medical device material.

Figure 12:
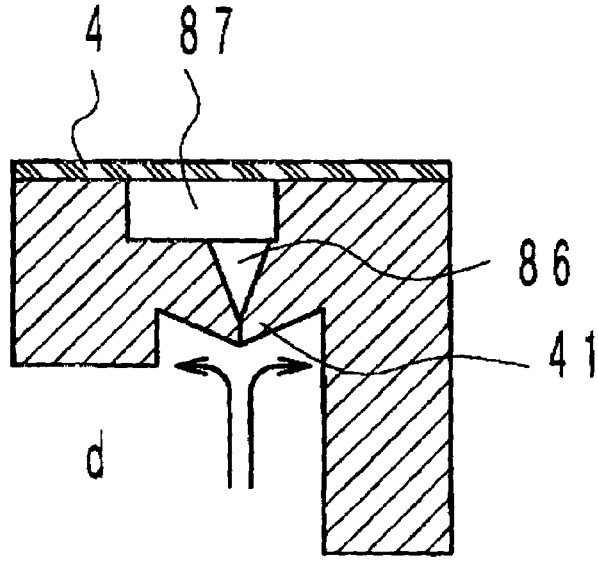
FIG. 12 illustrates a check valve 41, illustrated as a section view of a closed condition in Figure (A) and as a section view of an open condition in figure (B)
Figure 12:
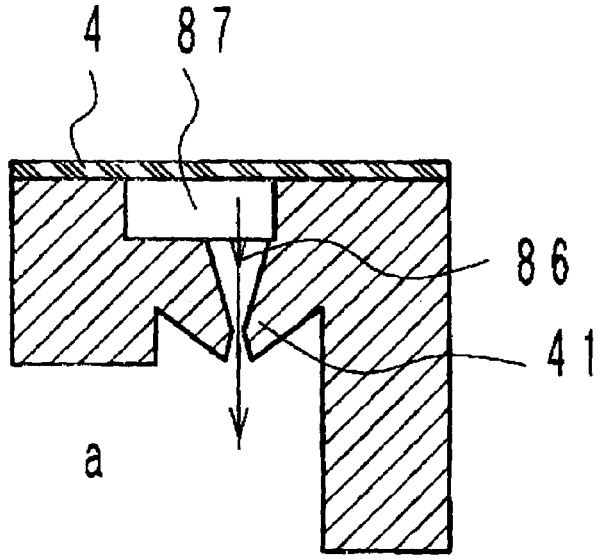

As shown in FIG. 12, the check valve 41 is directed so that it prevents outflow of the liquid drug (d) to the exterior of the container body (cf. FIG. 12A) but permits inflow of air (a) to the interior of the container body (cf. FIG. 12B).

Thus, when discharging the liquid drug from the nozzle hole 231 under the pressure the container body 1 with fingers, the liquid drug (d) is shut off by the check valve 41 and prevented from entering into the air-communicating hole 86, as shown in FIG. 12 (A). The same applies to the container body 1 in the normal state. When losing the pressure of fingers from the pressed container body 1, the container body 1 begins to swell up to the original configuration and the ambient air (a) begins to flow in the container body 1 through the air hole 24 and the air-communicating hole 86. At that time, the check valve 41 is opened slightly by a differential pressure between the atmosphere and a negative pressure in the container body 1 as shown in FIG. 12(B). Thus, the ambient air (a) flows into the container body through a narrow opening of the check valve 41.

Figure 9:
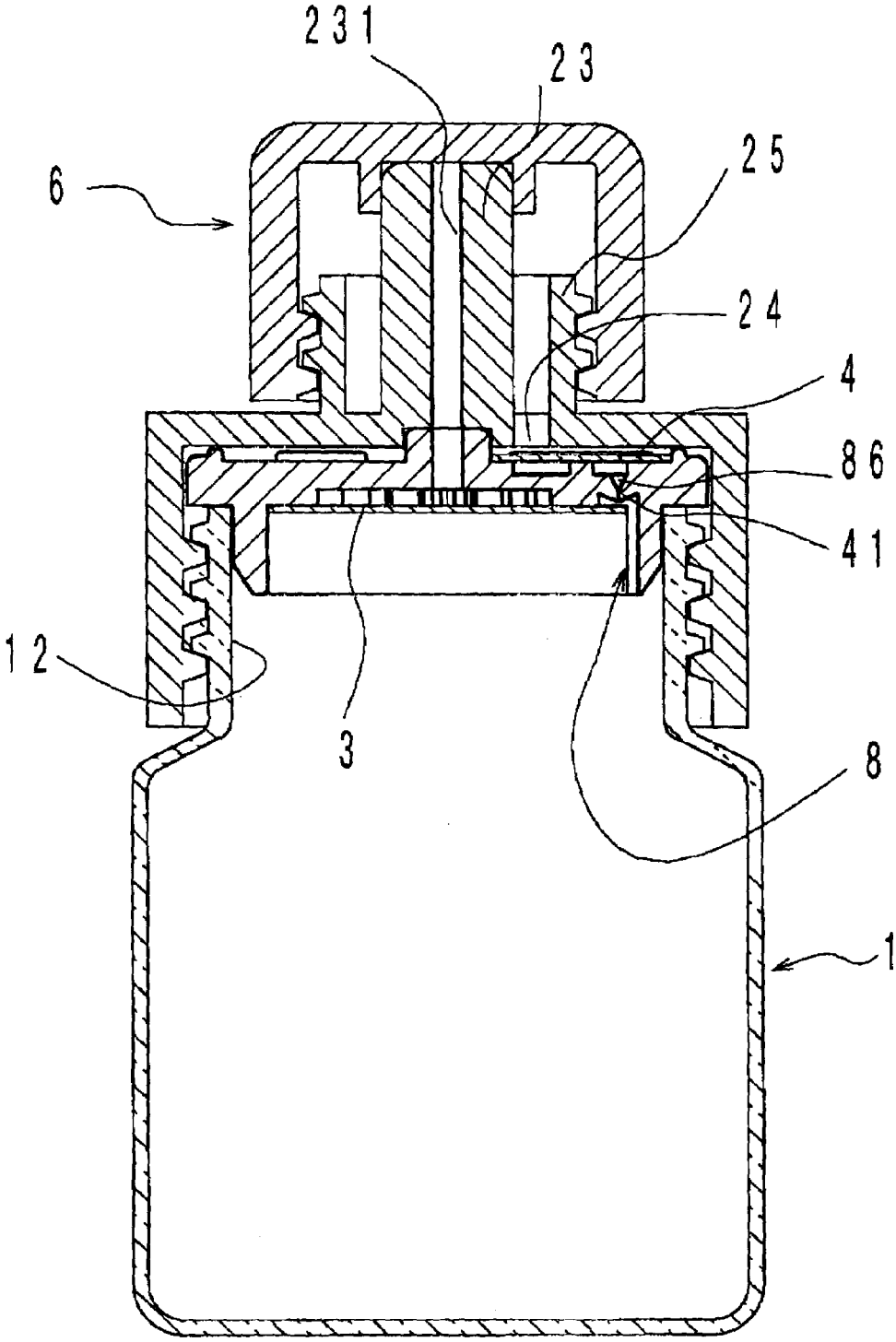
FIG. 9 is a sectional view of the liquid drug container.
Figure 10:
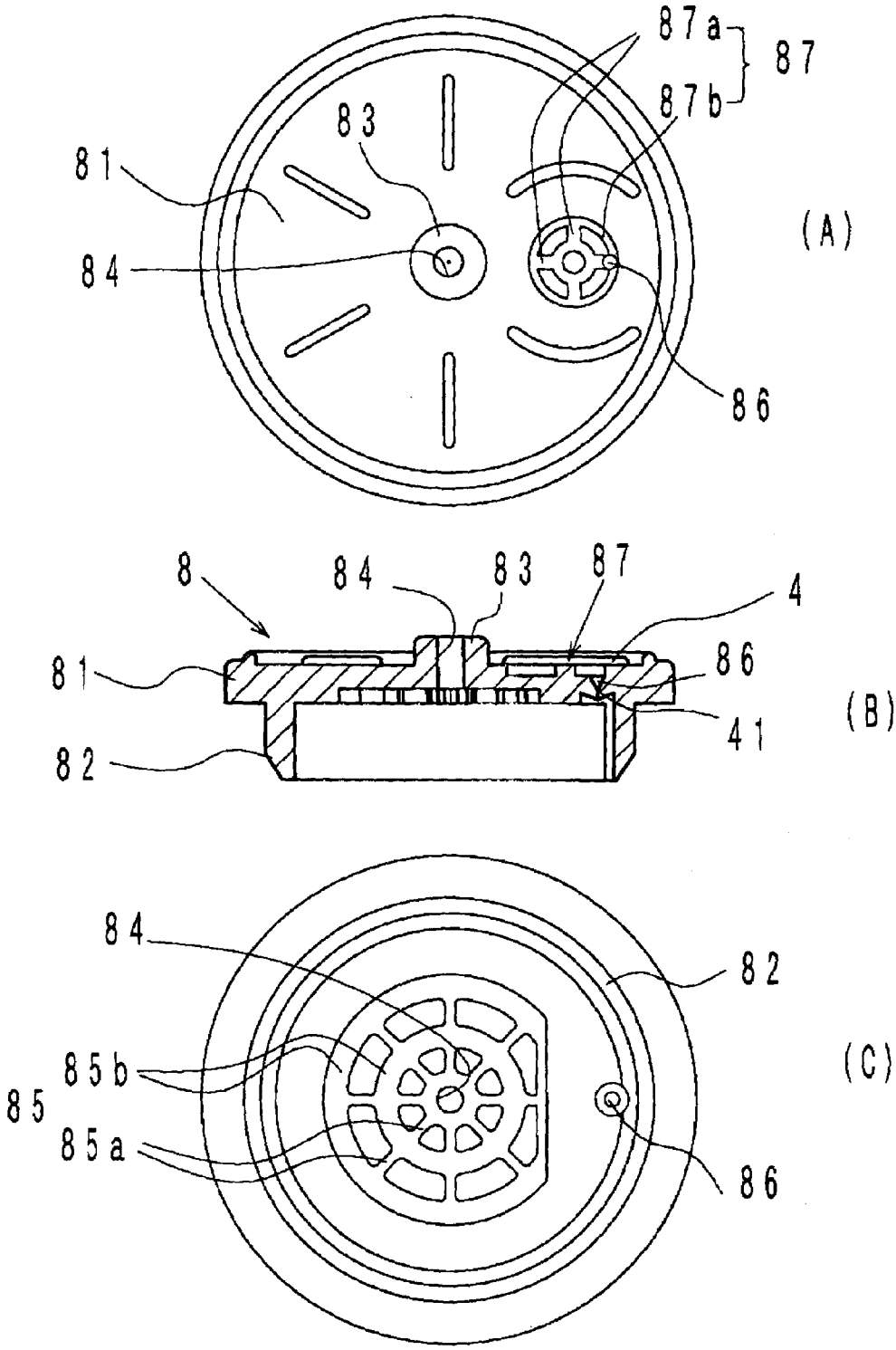
FIG. 10 is a filter-mounting member provided with no filter, including a plan view shown in the figure (A), a section view shown in the figure (B), and a bottom plan view shown in figure (C)

As shown in FIG. 9, the filter-mounting member 8 is fixed on the top of mouth 12 by screw-mounting the nozzle member 2 on the mouth ID of the container body 1. Under such a condition, the nozzle hole 231 of the nozzle 23 is communicated with the interior of container body 1 through the nozzle-communicating hole 84, while the air hole 24 is communicated with the interior of container body 1 through air-communicating hole 86.

Figure 11:
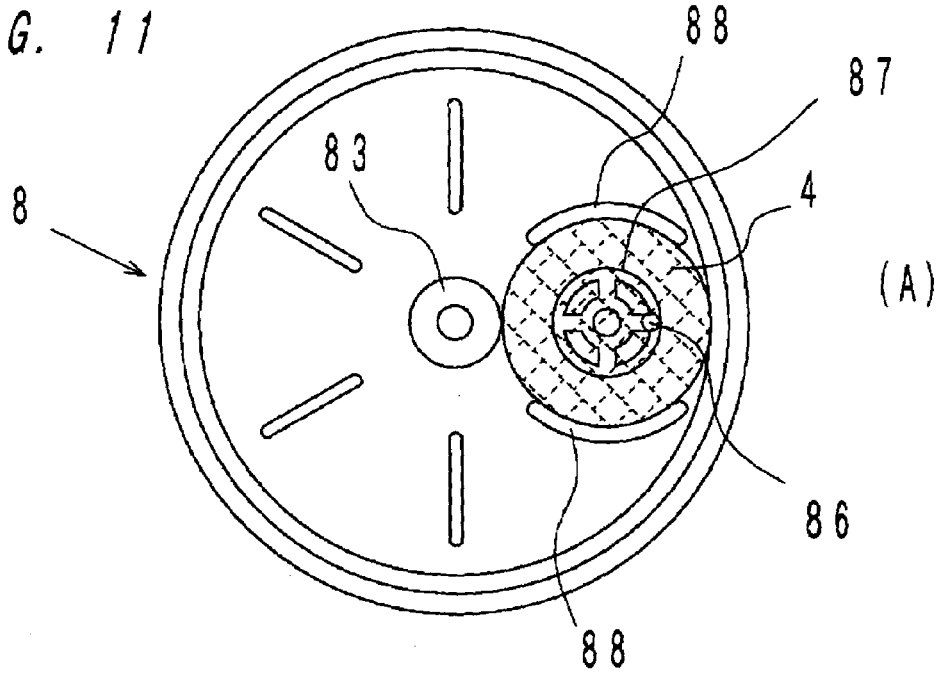
FIG. 11 is a filter-mounting member provided with a filter, including a plan view shown in the figure (A), and a bottom plan view shown in the figure (B)
Figure 11:
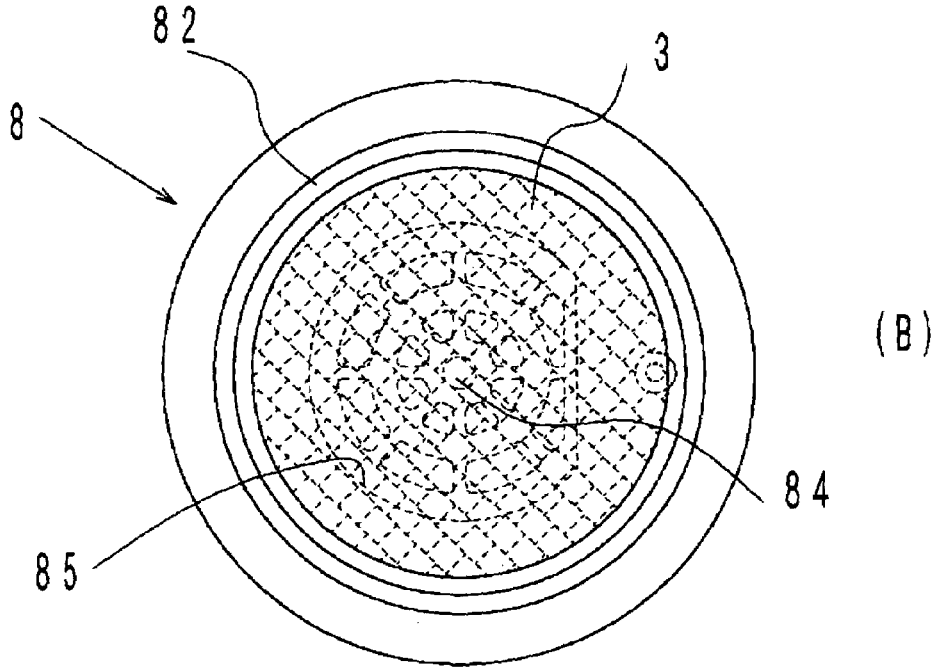

As shown in FIGS. 9 and 11, the hydrophilic filter 3 is attached to the bottom of the filter-mounting member 8, while the hydrophobic filter 4 is attached to the top of filter-mounting member 8.

In use, the nozzle cap 6 is removed firstly from the liquid drug container. Then, the container body 1 is pressed by fingers to discharge a liquid drug contained therein, the liquid drug is pushed out and dropped from the nozzle 23 through the hydrophilic filter 3. At that time, the check valve 41 is closed as shown in a figure of FIG. 12 (A) so that the liquid drug (d) does not enter into the air-communicating hole 86 and is kept in the condition out of contact with the hydrophobic filter 4. Thus, even if the liquid drug is incompatible with the material for hydrophobic filter 4, the hydrophobic filter 4 can be prevented from being deteriorated (for example, being changed to hydrophilic). Further, it is possible to prevent crystal deposition of the drug on the underside of the hydrophobic filter 4 (in the groove 87). In addition, it is possible to prevent growth of bacteria that take the liquid drug in the groove 87 as nutrients and display hyphal development on the top of the hydrophobic filter, for example, *Aureobasdium Pullulans* or *Aspergillus Oryzac*. This contributes to sterilization of the liquid drug.

After dropping a certain amount of the liquid drug, the container body 1 is loosed from the pressure. Thus, the container body 1 begins to expand so as to return to the original configuration due to its flexibility. At that time, the internal pressure of the container body 1 becomes negative. Because of a pressure difference between the negative pressure and the atmosphere pressure, the liquid drug which remains in the inside of nozzle hole 231 collected after stopping of discharge is returned in the container body 1 through the hydrophilic filter 3. On the other hand, the check valve 41 opens slightly as shown in figure of FIG. 12 (B), so that the ambient air (a) flows into the in container body 1 little by little even after the remaining liquid drug was returned in the container body 1. Thus, the container body 1 is restored to its original configuration slowly for a length of time, which in turn makes it possible to take enough time to allow the liquid drug remained on the hydrophilic filter 3 to be returned in the container body 1.

In this way, the negative pressure in the container body 1 ensures an adequate time required for the liquid drug to pass through the hydrophilic filter 3, thus making it possible to avoid retention of the remaining liquid drug in nozzle hole 231. Accordingly, it is possible to minimize a fear that the bacteria-contaminated liquid drug enters in the interior of the container body 1.

Figure 13:
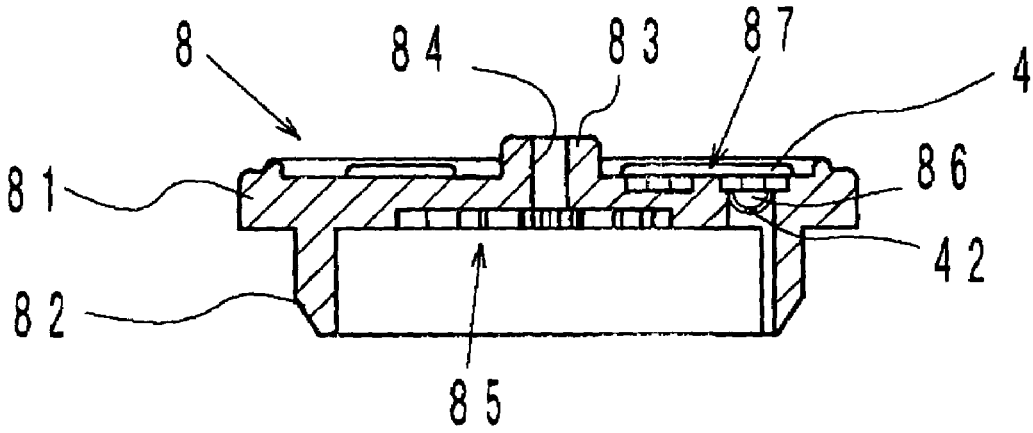
FIG. 13 is a section view of the filter-mounting member provided with a check valve used for a liquid drug container according to another embodiment of the present invention.
Figure 14:
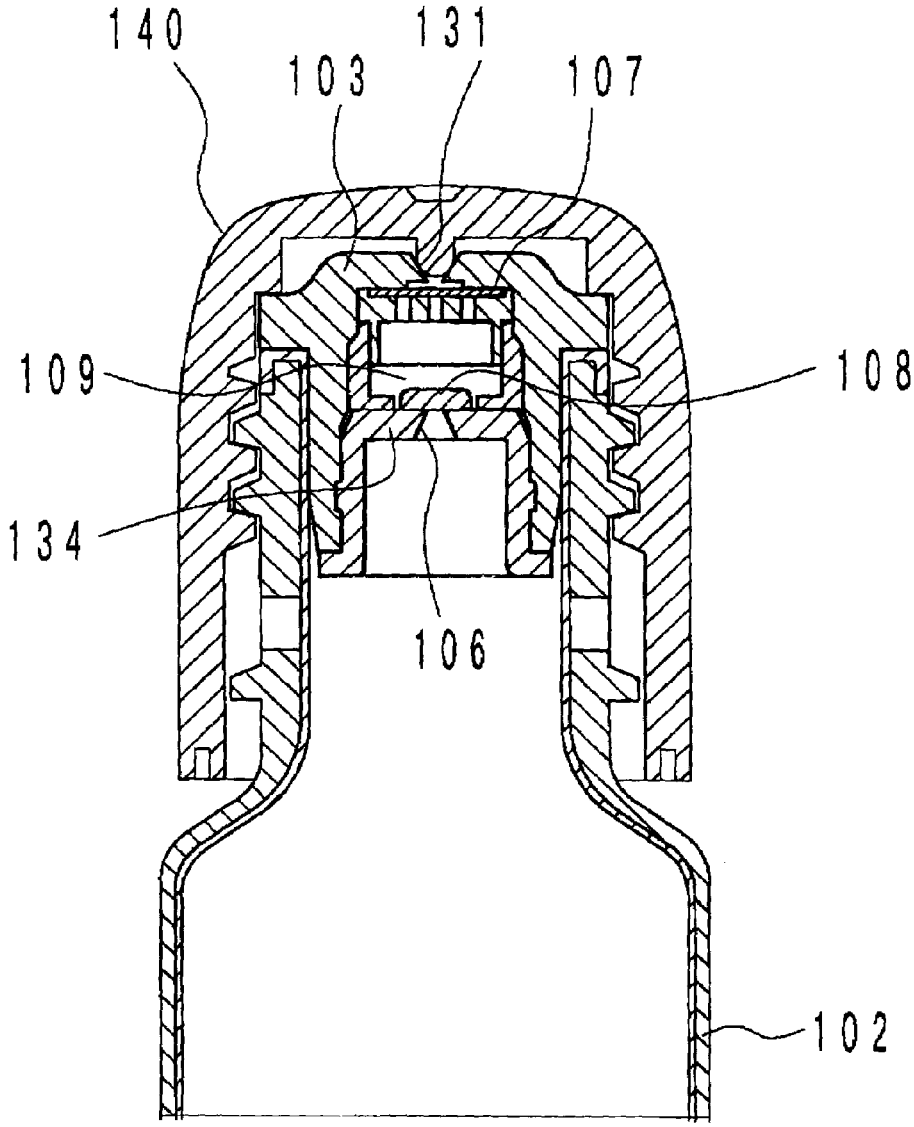
FIG. 14 is a section view of a liquid drug container of the prior art, illustrating details of a mouth thereof.

FIG. 13 illustrates another embodiment of the present invention, using a thin valve body as a check valve. Since the valve body is thin, the check valve 42 becomes sensitized to and is apt to be easily opened by the negative pressure in container body 1. However, if the valve body is thinned too much, the valve body opens too much, which in turn shortens the time for the liquid drug in the nozzle hole 231 to pass through the hydrophilic filter 3. Thus, the thickness the valve body is so determined that the flow of the liquid drug takes a suitable time period.

In each of the above embodiments, the check valve has been used as the flow control member. It is possible to substitute a diaphragm for the check valve. The diaphragm may be an orifice or a choke. The choke is a diaphragm with a length longer than a size of cross section of an opening, while orifice is a diaphragm having a length shorter than a size of cross section of an opening. In either diaphragm, it is sufficient to use the diaphragm if it ensures an enough time required to allow the liquid drug to pass through the hydrophilic filter 3 when the liquid drug in the nozzle hole 231 returns to the container body 1. This embodiment can also prevent bacteria from adhering to the liquid drug as is the case with the aforesaid embodiment, thus making it possible to obtain the same effect as that of the liquid drug container shown in FIG. 4.

In each embodiment, the check valve or the diaphragm has been arranged in the air-communicating hole 86 formed in the filter-mounting member 8. In an embodiment having no filter-mounting member 8, the check valve or the diaphragm may be arranged in an airflow path between the air hole 24 and the container body 1, e.g., in the air hole 24 or in the top wall 22 of the nozzle member 2.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A liquid drug container comprising a container body (1) having a mouth (12) and being deformable under the pressure, a cap-shaped nozzle member (2) liquid-tightly mounted on the mouth (12) of the container body (1), and a nozzle cap (6) mounted on the nozzle member (2), wherein said nozzle member (2) comprises a top wall (22) covering the mouth (12) of said container body (1), a skirt portion (21) extending from a peripheral portion of the top wall (22) toward a proximal end of the nozzle member (2), and a nozzle (23) extending from a central portion of said top wall (22) toward a distal end of the nozzle member (2), wherein said nozzle member (2) has a nozzle hole (231) passing through the top wall (22) to discharge a liquid drug contained in said container body (1), and an air hole (24) passing through the top wall (22) at a position separated from said nozzle hole (231) to allow an interior of said container body (1) to communicate with the outside thereof, wherein said nozzle member (2) is provided with a disk-shaped filter-mounting member (8) in said skirt portion (21), wherein said disk-shaped filter-mounting member (8) is provided with sets of grooves (85, 87) respectively communicated with said nozzle hole (231) and air hole (24), wherein said filter-mounting member (8) is provided with a hydrophilic filter (3) and a hydrophobic filter (4), and wherein said hydrophilic filter (3) is arranged on and welded to one side of said filter-mounting member to cover one set of grooves (85) communicated with said nozzle hole (231), while the hydrophobic filter (4) is arranged on and welded to the opposite side of said filter-mounting member to cover said air hole (24) and the other set of grooves (87) communicated with said air hole (24) as well as to avoid interference from said hydrophilic filter (3).

2. The liquid drug container according to claim 1, wherein each set of grooves (85, 87) include radial grooves (85*a*, 87*a*) communicated with the nozzle-communicating hole (84) or air-communicating hole (86) and annular grooves (85*b*, 87*b*) communicated with the radial grooves (85*a*, 87*a*).

3. The liquid drug container according to claim 2, wherein said hydrophilic filter (3) and hydrophobic filter (4) are in the form of a flat membrane.

4. The liquid drug container according to claim 1, wherein said hydrophilic filter (3) and hydrophobic filter (4) have a bore size of not more than 0.45 μm.

5. The liquid drug container according to claim 4, wherein said hydrophilic filter and hydrophobic filter have a bore size of not more than 0.22 μm.

6. The liquid drug container according to claim 1, wherein said disc-shaped filter-mounting member (8) is arranged in the skirt portion (21) and in close contact with an inner side of the top wall (22) of said nozzle member (2), wherein said disk-shaped filter-mounting member (8) is provided at a central portion thereof with a nozzle-communicating hole (84) passing therethrough and being communicated with said nozzle hole (231), and at a position spaced from said nozzle-communicating hole (84) with an air-communicating hole (86) passing therethrough and being communicated said air hole (24) through said grooves (87).

7. The liquid drug container according to claim 1, wherein is provided with a flow control member (41) that controls air flowing into the container body from the exterior of the container body (1) through the air hole (24), said flow control member (41) being arranged in the air-communicating hole (86).

8. The liquid drug container according to claim 7, wherein said air-communicating hole is provided with a flow control member that controls the air flowing into the container body from the exterior of the container body.

9. The liquid drug container according to claim 8, wherein said flow control member is a check valve or a diaphragm.

10. A liquid drug container comprising a container body having a mouth and being deformable under the pressure, a cap-shaped nozzle member liquid-tightly mounted on the mouth of the container body, and a nozzle cap mounted on the nozzle member, wherein said nozzle member comprises a top wall covering the mouth of said container body, a skirt portion extending from a peripheral portion of the top wall toward a proximal end of the nozzle member, and a nozzle extending from a central portion of said top wall toward a distal end of the nozzle member, wherein said nozzle member has a nozzle hole passing through the top wall to discharge a liquid drug from said container body, and an air hole passing through the top wall at a position separated from said nozzle hole to allow an interior of said container body to communicate with the outside thereof, wherein the top wall of said nozzle member is provided on one side thereof with a set of grooves communicated with said nozzle hole, and on the opposite side with a set of grooves communicated with said air hole, wherein said top wall is provided with a hydrophilic filter and a hydrophobic filter, and wherein said hydrophilic filter is arranged on and welded to one side of said top wall to cover said nozzle hole and one set of grooves communicated with said nozzle hole, while the hydrophobic filter is arranged on and welded to the opposite side of said top wall to cover said air hole and the other set of grooves communicated with said air hole as well as to avoid interference from said hydrophilic filter (3).

11. The liquid drug container according to claim 10, wherein each set of grooves include radial grooves (51*a*, 52*a*) communicated with the nozzle hole (231) or air hole (24), and annular grooves (51*b*, 52*b*) communicated with the radial grooves (51*a*, 52*a*).

12. The liquid drug container according to claim 10, wherein said hydrophilic filter and a hydrophobic filter are in the form of a flat membrane.

13. The liquid drug container according to claim 10, wherein said hydrophilic filter and hydrophobic filter have a bore size of not more than 0.45 μm.

14. The liquid drug container according to claim 10, wherein the nozzle member is provided with a flow control member that controls air flowing into the container body from the outside through the air hole, said flow control member being arranged in the air hole.

15. The liquid drug container according to claim 14, wherein said flow control member is a check valve or a diaphragm.

* * * * *